US009745744B2

(12) United States Patent
Morgan, III et al.

(10) Patent No.: US 9,745,744 B2
(45) Date of Patent: Aug. 29, 2017

(54) ACOUSTIC SYSTEMS FOR LIGHTING IN SUSPENDED CEILINGS

(75) Inventors: Herbert J. Morgan, III, Berkeley Heights, NJ (US); Mark A. Adkins, East Brunswick, NJ (US)

(73) Assignee: Spirit Acoustics Inc., South Plainfield, NJ (US)

( * ) Notice: Subject to any disclaimer, the term of this patent is extended or adjusted under 35 U.S.C. 154(b) by 0 days.

(21) Appl. No.: 13/175,935

(22) Filed: Jul. 4, 2011

(65) Prior Publication Data

US 2011/0259665 A1 Oct. 27, 2011

Related U.S. Application Data

(63) Continuation of application No. 12/013,294, filed on Jan. 11, 2008, now Pat. No. 7,971,680, which is a continuation of application No. PCT/US2006/026735, filed on Jul. 11, 2006.

(60) Provisional application No. 60/698,017, filed on Jul. 12, 2005.

(51) Int. Cl.

| | |
|---|---|
| ***E04B 9/00*** | (2006.01) |
| ***E04B 9/04*** | (2006.01) |
| ***E04B 9/32*** | (2006.01) |
| *F21S 8/02* | (2006.01) |
| *F21Y 103/30* | (2016.01) |

(52) U.S. Cl.

CPC ..... *E04B 9/001* (2013.01); *E04B 9/045* (2013.01); *E04B 9/0435* (2013.01); *E04B 9/0464* (2013.01); *E04B 9/0478* (2013.01); *E04B 9/0485* (2013.01); *E04B 9/32* (2013.01); *F21S 8/026* (2013.01); *F21Y 2103/30* (2016.08)

(58) Field of Classification Search

CPC ..... E04R 9/001; E04R 9/0435; E04R 9/0426; E04R 9/006; E04B 9/001; E04B 9/0435; E04B 9/0426; E04B 9/006; E04B 9/045; E04B 9/0464; E04B 9/0478; E04B 9/0485; E04B 9/32; F21S 8/026; F21S 8/06; F21Y 2103/30

USPC .... 52/144, 145, 28, 506.06, 741.3; 362/144, 362/346, 364, 348

See application file for complete search history.

(56) References Cited

U.S. PATENT DOCUMENTS

| | | | |
|---|---|---|---|
| 2,306,685 A | 12/1942 | Chambers | 189/85 |
| 2,659,807 A | 11/1953 | Wakefield | 240/9 |
| 2,659,808 A | 11/1953 | Beckwith | 240/9 |

(Continued)

OTHER PUBLICATIONS

International Search Report for PCT application No. PCT/US2006/026735, dated Jan. 22, 2007.

(Continued)

*Primary Examiner* — James Ference

(74) *Attorney, Agent, or Firm* — Watkins Law & Advocacy, PLLC

(57) ABSTRACT

An acoustic housing, a light fixture, a suspended ceiling system, and a method of decreasing sound transfer from a light fixture in a suspended ceiling are disclosed. An acoustic hood for a light fixture in a suspended ceiling may include a partially enclosed space formed between a plurality of wall portions. A light fixture may include first and second layers that are coupled to one another and form a partially enclosed space. A suspended ceiling system may include the acoustic hood or light fixture. The method relates to disposing an acoustic housing spaced from the light fixture.

37 Claims, 11 Drawing Sheets

(56) References Cited

U.S. PATENT DOCUMENTS

| | | | | |
|---|---|---|---|---|
| 2,683,408 | A | 7/1954 | Brown et al. | 98/40 |
| 2,710,335 | A | 6/1955 | Wong | 240/9 |
| 2,715,449 | A | 8/1955 | Lemmerman et al. | 181/30 |
| 2,752,017 | A | 6/1956 | Segil | 189/88 |
| 2,759,093 | A | 8/1956 | Ferar et al. | 240/2 |
| 2,830,330 | A | 4/1958 | Heath | 20/4 |
| 2,850,109 | A | 9/1958 | Benjamin | 181/33 |
| 2,926,237 | A * | 2/1960 | Sorenson | F21V 17/107 362/150 |
| 2,978,571 | A | 4/1961 | Rosenblatt | 240/9 |
| 3,004,141 | A | 10/1961 | Waller et al. | 240/9 |
| 3,021,915 | A * | 2/1962 | Kemp | E04B 9/001 181/290 |
| 3,080,914 | A * | 3/1963 | Shippee | E04B 9/0485 165/135 |
| 3,121,259 | A | 2/1964 | Versen | 20/4 |
| 3,183,996 | A * | 5/1965 | Capaul | E04B 1/90 181/291 |
| 3,253,675 | A | 5/1966 | Baruch | 181/33 |
| 3,319,559 | A | 5/1967 | Raider et al. | 98/40 |
| 3,321,877 | A | 5/1967 | Alexieff | 52/144 |
| 3,343,310 | A | 9/1967 | Netz et al. | 52/28 |
| 3,372,270 | A * | 3/1968 | Garnett | E04B 9/32 362/149 |
| 3,460,299 | A | 8/1969 | Wilson | 52/144 |
| 3,509,668 | A | 5/1970 | Ollinger et al. | 52/28 |
| 3,581,448 | A | 6/1971 | Roux | 52/28 |
| 3,591,794 | A | 7/1971 | Dail | 240/9 |
| 3,743,826 | A * | 7/1973 | Halfaker | E04B 9/00 362/149 |
| 3,780,286 | A | 12/1973 | Alexieff et al. | 240/78 LD |
| 3,786,602 | A | 1/1974 | Wilkin | 52/28 |
| 3,796,870 | A * | 3/1974 | Pettyjohn, Jr. | F21S 8/02 362/223 |
| 3,831,019 | A | 8/1974 | Halfaker et al. | 240/9 R |
| 3,848,385 | A * | 11/1974 | Thompson | E04B 9/008 403/173 |
| 3,857,459 | A | 12/1974 | Adams et al. | 181/33 GD |
| 3,903,660 | A | 9/1975 | Akins | 52/27 |
| 3,922,073 | A | 11/1975 | Schwartz | 350/319 |
| 4,094,379 | A | 6/1978 | Steinberger | 181/284 |
| 4,175,360 | A * | 11/1979 | Mulvey | E04B 9/0428 362/148 |
| 4,210,070 | A | 7/1980 | Tatum et al. | 98/40 D |
| 4,493,171 | A | 1/1985 | Stahlhut | 52/28 |
| 4,829,728 | A | 5/1989 | Castelli | 52/145 |
| 4,923,032 | A | 5/1990 | Nuernberger | 181/150 |
| 5,111,370 | A * | 5/1992 | Clark | 362/147 |
| 5,161,878 | A * | 11/1992 | Degelmann | F21V 21/04 362/150 |
| 5,206,464 | A | 4/1993 | Lamm et al. | 181/150 |
| 5,345,729 | A * | 9/1994 | Prahst et al. | 52/28 |
| 5,501,042 | A * | 3/1996 | Gustaveson | H04N 5/64 248/917 |
| 5,533,306 | A | 7/1996 | Aspenson | 52/144 |
| 5,782,551 | A * | 7/1998 | Capaul | B32B 15/14 362/148 |
| 5,832,685 | A | 11/1998 | Hermanson | 52/506.07 |
| 5,873,556 | A * | 2/1999 | Reiker | 248/323 |
| 5,992,561 | A | 11/1999 | Holben et al. | 181/295 |
| 6,105,334 | A * | 8/2000 | Monson | F21S 8/02 52/232 |
| 6,123,438 | A * | 9/2000 | Hentz | F21S 8/02 362/148 |
| 6,179,451 | B1 | 1/2001 | Bodine et al. | 362/404 |
| 6,234,643 | B1 * | 5/2001 | Lichon, Jr. | 362/147 |
| 6,286,980 | B1 * | 9/2001 | Meyer | 362/365 |
| 6,357,891 | B1 * | 3/2002 | Newbold | F21S 8/02 362/147 |
| 6,367,581 | B1 | 4/2002 | Marler et al. | 181/295 |
| 6,367,955 | B1 * | 4/2002 | Rhee | B60Q 3/0203 362/147 |
| 6,450,289 | B1 | 9/2002 | Field et al. | 181/224 |
| 6,464,179 | B1 * | 10/2002 | Bulvan et al. | 248/58 |
| 6,481,173 | B1 | 11/2002 | Roy et al. | 52/506.07 |
| 6,508,567 | B1 | 1/2003 | Fiene | 362/147 |
| 6,637,710 | B2 * | 10/2003 | Yaphe et al. | 248/317 |
| 6,807,785 | B2 | 10/2004 | Lynch et al. | 52/506.06 |
| 6,860,617 | B2 * | 3/2005 | Fiene | 362/147 |
| 7,338,182 | B1 | 3/2008 | Hastings et al. | 362/150 |
| 7,481,550 | B1 * | 1/2009 | Schreiber et al. | 362/148 |
| 7,627,999 | B2 * | 12/2009 | Latanision | 52/407.4 |
| 7,824,080 | B2 * | 11/2010 | Gibson et al. | 362/364 |
| 7,841,135 | B2 * | 11/2010 | Newbold et al. | 52/28 |
| 2002/0157324 | A1 * | 10/2002 | Newbold | F21S 8/02 52/27 |
| 2003/0221296 | A1 * | 12/2003 | Gijsel et al. | 24/298 |
| 2004/0070967 | A1 | 4/2004 | Kennedy | 362/147 |
| 2005/0066618 | A1 | 3/2005 | Tucker | 52/782.1 |
| 2005/0133299 | A1 | 6/2005 | Schnitta | 181/205 |
| 2006/0274522 | A1 * | 12/2006 | Williams et al. | 362/217 |
| 2008/0155915 | A1 * | 7/2008 | Howe et al. | 52/220.3 |
| 2008/0219001 | A1 * | 9/2008 | Russell | 362/246 |
| 2009/0255753 | A1 | 10/2009 | Schnitta | 181/205 |

OTHER PUBLICATIONS

Written Opinion for PCT application No. PCT/US2006/026735, dated Jan. 22, 2007.

International Preliminary Report on Patentability for PCT application No. PCT/US2006/026735, dated Jan. 16, 2008.

Thermafiber® Light Fixture Protection Kits, SC897/rev. 10-99, USG Interiors, Inc., 1999 (2 pages).

Thermafiber® releases FixtureShield® kits, New Release, Oct. 17, 2012 (1 page).

Thermafiber® FixtureShield®, TF897/Rev 02-14, Thermafiber, Inc., 2014 (2 pages).

FixtureShield® Quote Request Form, Thermafiber, undated (1 page).

MSDS No. FF130, Tenmat Ltd, Manchester, England, Apr. 2005 (6 pages).

Model FF130 Technical Product Specifications, Tenmat Inc., undated (1 page).

Assessment of the FF130 luminaire cover, Report reference Chilt/A04038 Revision A, Chiltern International Fire Ltd, issue date Jul. 6, 2005 (7 pages).

Global Fire Resistance Assessment of the: FF130 luminaire cover, Report reference Chilt/A04038 Revision B, Chiltern International Fire Ltd, valid from Nov. 1, 2010 (8 pages).

Tenmat FF130 Fire Rated Troffer Cover. Installation Instruction. Tenmat Inc., undated (1 page).

Tenmat FF130 Flexible Luminaire Cover, Tenmat Ltd, Issue Apr. 2012 (2 pages).

FF130 Flexible Fluorescent Fixture Protection Covers, printed from https://web.archive.org/web/20040825061431/http://tenmat-us.com/popups/ff109_130.html from Aug. 25, 2004 (1 page).

Listings and Approvals, Tenmat Fire Rated Fixture Protection Covers, Tenmat Inc., 2004, printed from https://web.archive.org/web/20040824195708/http://tenmat-us.com/listing_approvals.html from Aug. 24, 2004 (3 pages).

FAQ's, Tenmat Fire Rated Fixture Protection Covers, Tenmat Inc., 2004, printed from https://web.archive.org/web/20040824195432/http://tenmat-us.com/faq.html from Aug. 24, 2004 (3 pages).

Installation Instructions. FF130 Flexible Fluorescent Fixture Protection Cover, printed from https://web.archive.org/web/20040825061229/http://tenmat-us.com/installation/ff130_install.html from Aug. 25, 2004 (1 page).

New—Thermafiber® FixtureShield®. Thermafiber. Inc . . . 2012 (12 pages).

FixtureShield® Light Fixture Protection Kits, Thermafiber, Inc., http://www.thermafiber.com/fixtureshield, undated (1 page).

SafeLite®, Winroc-SPI, Jan. 2014 (2 pages).

SafeLite® Case History, Project: Forever 21 Retail Store, Orland Park, IL, SPI, undated (1 page).

SafeLite® Case History, Project: E. A. Laney High School, 2700 N. College Road, Wilmington, NC, SPI, undated (1 page).

(56) References Cited

OTHER PUBLICATIONS

SafeLite® Installation Steps and SafeLite® Installation Instructions, Sep. 2013 (8 pages).
SafeLite® product specifications regarding 07 84 13 Penetration Firestopping, 09 81 13 Acoustic Board Insulation, and 07 21 13.19 Mineral Board Insulation, Winroc-SPI, undated (3 pages).
SafeLite®, Winroc-SPI, 2.14 (32 pages).
Hush Box Datasheet, BRD Noise & Vibration Control, Inc., printed from HIS GlobalSpec on Feb. 20, 2014 (1 page).

* cited by examiner

ACOUSTIC SYSTEMS FOR LIGHTING IN SUSPENDED CEILINGS

CROSS-REFERENCE TO RELATED APPLICATION APPLICATIONS

This application is a continuation of U.S. patent application Ser. No. 12/013,294 filed Jan. 11, 2008 now U.S. Pat. No. 7,971,680 and entitled "Acoustic Systems for Lighting in Suspended Ceilings," and further is a continuation of the U.S. National Stage designation of co-pending International Patent Application PCT/US2006/026735 filed Jul. 11, 2006, which claims the benefits of U.S. Provisional Application No. 60/698,017 filed Jul. 12, 2005 and entitled "Acoustic Systems for Lighting in Suspended Ceilings" under 35 U.S.C. §119(e), and the entire contents of all of these applications are expressly incorporated herein by reference thereto.

FIELD OF THE INVENTION

The invention relates to acoustic hoods and light fixtures for use with a suspended ceiling. More particularly, the invention relates to an acoustic hood for use with or integrally formed with a light fixture for a suspended ceiling system. The invention further relates to a method of decreasing sound transfer from a light fixture in a suspended ceiling.

BACKGROUND OF THE INVENTION

Many types of buildings, such as commercial and government office buildings, utilize suspended ceilings. Suspended ceilings typically include a suspension grid system and acoustical panels. The grid system for example may be used to suspend the panels, otherwise known as tiles, from the overhead building structure generally in a single plane. The suspended ceiling is formed by coupling the grid to hangar wires attached to the building structure, and thus the load of the grid system with its associated lighting components, air distribution components, and acoustical panels is transferred to the building structure by the hanger wires. A variety of types of lay-in ceiling panels are available for use with exposed grids including cast, water-felted, fiber glass, gypsum, and metal.

Grid systems may be formed using main beams or "tees," cross tees, and hangers. The main beams are metal framing members that are hung from the hangers. The cross tees typically are metal framing members snap-fitted to the main beams, perpendicular thereto.

One popular variant of the suspended ceiling is a suspended ceiling system that utilizes a grid framework formed of inverted T-shaped frame members for the main tees and cross tees. The frame members are configured to form a suspended grid including multiple grid elements, which are known as modules. These modules may be provided in any practicable size, with 24-inch squares being a common module size. The suspended ceiling is formed by installing ceiling tiles in a number of modules such that each edge portion of the bottom surface of each tile is supported by an inverted T cross bar—a main or cross tee. The suspended ceiling system is completed by including required utilities in the system such as fire sprinklers, heating, ventilating and air conditioning (HVAC) elements, and lighting fixtures. Suspended ceiling systems for example may provide decoration, light reflection, and/or masking of utility infrastructure.

In many applications, it is desirable that a suspended ceiling system provide a significant degree of acoustic insulation or damping. In particular, in an office environment where speech privacy is important, it is desirable to limit the amount of sound that can otherwise travel through the ceiling in one office, conference room, or space and be readily received in another office, conference room, or space.

Utilizing ceiling tiles made from sound absorbing material can provide a measure of acoustic insulation in a suspended ceiling system. For example, U.S. Pat. No. 5,832,685 to Hermanson is directed to a self-supporting, sound absorbing interior surface panel as well as a suspended ceiling module comprising a support structure, such as a tee bar grid, and a panel which could be supported within the module in either tegular or coffered orientation.

Using sound absorbing ceiling tiles alone, however, does not provide acoustic insulation at modules of a suspended ceiling system where lighting fixtures are installed. To this end, various devices are known for providing acoustic insulation with respect to lighting fixtures.

For example, U.S. Pat. No. 4,094,379 to Steinberger is directed to a sound-absorption panel. The panel is suspended in horizontal position toward a light and need only be translucent to permit light to pass downwardly and so as hide objects above the ceiling.

U.S. Pat. No. 6,450,289 B1 to Field et al. is directed to a noise attenuation device. A noise attenuator is disclosed for use adjacent to a light fitting for attenuating noise from air conditioning or an air supply to offices. The attenuator can be connected to the duct system above a standard vent slot adjacent a light fitting and connected to an office air conditioning system.

U.S. Pat. No. 6,481,173 B1 to Roy et al. is directed to a flat panel sound radiator with special edge details. A flat panel radiator is mounted inside a tegular frame with the lower edge of the tegular frame below the flanges of the main beams. The radiator panel can be fabricated from a honeycomb core. A combination of containment elements and isolation elements are used to isolate the radiator panel from the tegular frame both mechanically and acoustically. An acoustic scrim is attached to the bottom of the tegular frame.

Despite these developments, there remains a need for an improved acoustic housing that can be positioned above a lighting fixture installed in a suspended ceiling system. There further remains a need for an acoustic housing such as an acoustic hood that is not supported by ceiling tiles, thereby allowing ceiling tiles to be removed or replaced without being disturbed. Additionally, there remains a need to an acoustic housing that is formed in multiple parts for ease of installation in the constricted confines presented by known suspended ceiling systems. There also remains a need for a recessed light fixture that includes an acoustic component such as at least one soundproofing layer, thereby providing sound absorption where the light fixture is installed as a component of a suspended ceiling system.

SUMMARY OF THE INVENTION

The invention relates to an acoustic hood for a light fixture in a suspended ceiling, the acoustic hood including a partially enclosed space formed between a plurality of wall portions. The wall portions may be a plurality of sides that together define the partially enclosed space. At least one of the sides may have at least one utility slot, at least one positioning slot, and/or at least one ventilation opening.

The acoustic hood may be formed of fiberglass which in some embodiments may have a thickness between about 0.5 inch and about 1.5 inches. In some embodiments, the acoustic hood may he formed of unitary construction, while in other embodiments the acoustic hood may be formed of several portions such as two separate and substantially symmetrical portions.

The acoustic hood may be configured and dimensioned to have a noise reduction coefficient of at least about 0.70, at least about 0.80, or at least about 0.90.

In one exemplary embodiment, the acoustic hood may have a first layer formed of fiberglass and a second layer, wherein the acoustic hood is configured and dimensioned to have a noise reduction coefficient of at least about 0.7 and a sound transmission class of at least about 20.

In another exemplary embodiment, the acoustic hood may have a first layer formed of fiberglass and a second layer, wherein the acoustic hood is configured and dimensioned to have a noise reduction coefficient of at least about 0.8 and a sound transmission class of at least about 30.

The invention also relates to a light fixture including a first layer formed of a first material selected from the group consisting of fiberglass and polyester, a second layer formed of metal, and at least one socket configured to connect to a light source. The first and second layers may be coupled to one another and form a partially enclosed space. In addition, the first and second layers may mate together and may be nested. In some embodiments, the first layer may be nested within the second layer, while in other embodiments the second layer may be nested within the first layer.

The light fixture may further include a third layer formed of a mesh, wherein the third layer mates with and is coupled to at least one of the first and second layers. The light fixture also may include a ballast, a starter switch, and/or a diffuser.

The first material may be fiberglass with a thickness between about 0.5 inch and about 1.5 inches. Moreover, the partially enclosed space may be configured and dimensioned to have a noise reduction coefficient of at least about 0.7, at least about 0.8, or at least about 0.9.

The invention also relates to a light fixture including a first layer formed of a first material selected from the group consisting of fiberglass and polyester, a second layer formed of a second material, and at least one socket configured to connect to a light source. The first and second layers may be coupled to one another and form a partially enclosed space, and the light fixture may be configured and dimensioned to have a noise reduction coefficient of at least about 0.7 and a sound transmission class of at least about 20. In some embodiments, the light fixture may be configured and dimensioned to have a noise reduction coefficient of at least about 0.8 and a sound transmission class of at least about 20.

The invention further relates to a suspended ceiling system including a grid formed by a plurality of frame members, at least one acoustic panel supported by the grid, a light fixture supported by the grid, and an acoustic hood for the light fixture, the acoustic hood including a partially enclosed space formed between a plurality of wall portions. The suspended ceiling system may further include at least one light source disposed in the light fixture.

In addition, the invention relates to a suspended ceiling system including a grid formed by a plurality of frame members, at least one acoustic panel supported by the grid, and a light fixture supported by the grid. The light fixture may have a first layer formed of a first material selected from the group consisting of fiberglass and polyester, a second layer formed of metal, and at least one socket configured to connect to a light source, with the first and second layers being coupled to one another and forming a partially enclosed space. At least one light source may be disposed in the light fixture.

Furthermore, the invention relates to a method of decreasing sound transfer from a light fixture in a suspended ceiling, the method comprising: disposing an acoustic housing spaced from the light fixture. The method may further comprise: supporting the acoustic housing on at least one frame member of the suspended ceiling so that the acoustic housing and light fixture do not contact one another.

In some embodiments, the acoustic housing may include at least one positioning slot and the at least one frame member may include a protruding portion, the method further including: registering the at least one positioning slot with the protruding portion so that the acoustic housing is supported on the at least one frame member.

The method may further include: at least partially surrounding the light fixture with the acoustic housing.

Also, the method may further include: supporting at least one edge of the acoustic housing on at least one frame member of the suspended ceiling so that the acoustic housing and light fixture do not contact one another.

In some embodiments, the method includes: coupling at least one spacer to the acoustic housing; and coupling the at least one spacer to at least one frame member of the suspended ceiling. The spacer may have a slot and the at least one frame member may have an inverted T-shape with a stem portion, the method further including disposing the stem portion in the slot.

In some embodiments, the acoustic housing may have substantially symmetrical halves, and the method may further include: supporting a first of the halves; and supporting a second of the halves.

In other embodiments, the method may include: coupling at least one spacer to the light fixture; and coupling the acoustic housing to the spacer so that the acoustic housing is supported by the light fixture in spaced relation thereto. The spacer may be a post.

In yet other embodiments, the method may include: supporting the acoustic housing from an overlying surface which may be selected from the group consisting of concrete structure, an I-beam, and a ribbed steel pan.

In yet further embodiments, the method may include: coupling the acoustic housing to a hanger; coupling the hanger to the overlying surface; wherein the acoustic housing is supported by the overlying surface in spaced relation thereto. The hanger may be a metal cable.

In some embodiments of the method, the acoustic housing may provide a noise reduction coefficient of at least 0.7, at least 0.8, or at least 0.9. Also, in some embodiments of the method, the acoustic housing provides a sound transmission class of at least about 15, at least about 20, at least about 25, or at least about 30.

The invention additionally relates to an acoustic housing provided for use with lighting fixtures installed as part of a suspended ceiling system. The acoustic housing may be formed from a sound absorbing material and may include a top surface and sides that define an open space, and may be positioned above an installed light fixture. The acoustic housing may be supported on inverted T-shaped frame members of suspended ceiling systems or may be otherwise supported over an underlying lighting fixture.

BRIEF DESCRIPTION OF THE DRAWINGS

Preferred features of the present invention are disclosed in the accompanying drawings, wherein.

DETAILED DESCRIPTION OF THE PREFERRED EMBODIMENTS

Figure 1:
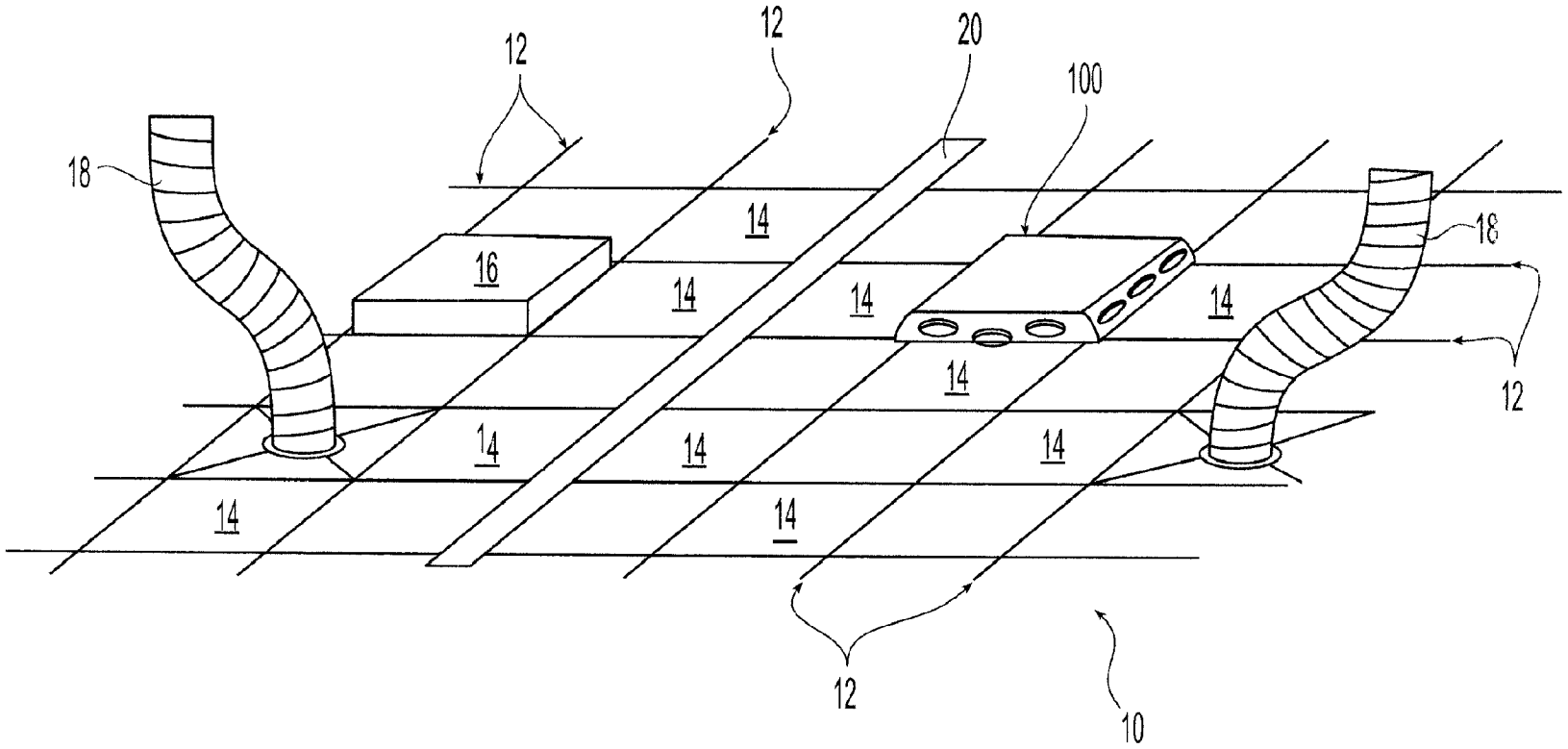
FIG. 1 shows a perspective view of an embodiment of a ceiling system with an acoustic housing installed according to the present invention.

Referring initially to FIG. 1, an exemplary embodiment of a suspended ceiling system 10 according to the present invention includes a grid formed by frame members 12, which may be main beams or cross tees as previously described. In a preferred exemplary embodiment, frame members 12 are inverted T-shaped members. Ceiling tiles 14 are positioned in and supported by the grid formed by frame members 12. Where frame members 12 are inverted T-shaped members, ceiling tiles 14 are installed such that an edge portion of a bottom surface of each ceiling tile 14 rests on a crossbar portion of an inverted T-shaped frame member. Preferably, the crossbar portion is disposed in a plane generally parallel to a plane defined by the ceiling tile. Suspended ceiling system 10 also may include lighting fixtures 16 and HVAC elements 18. Lighting fixtures 16 are installed in desired locations in the grid formed by frame members 12. Ceiling system 10 also may include at least one acoustic housing 100. Each acoustic housing 100 preferably is disposed to provide acoustic shielding proximate a respective light fixture 16. Thus, as shown in FIG. 1, acoustic housing 100 is disposed above a light fixture 16 which otherwise is not shown in the view of FIG. 1. In an exemplary preferred embodiment, each ceiling tile 14 and light fixture 16 are generally about 2 feet by about 2 feet in largest footprint, although in an alternate embodiment rectangular shapes such as about 2 feet by about 4 feet in dimension may be used for ceiling tile 14 and light fixture 16. A sheet rock partition 20 also is shown, as known in the art.

Figure 2:
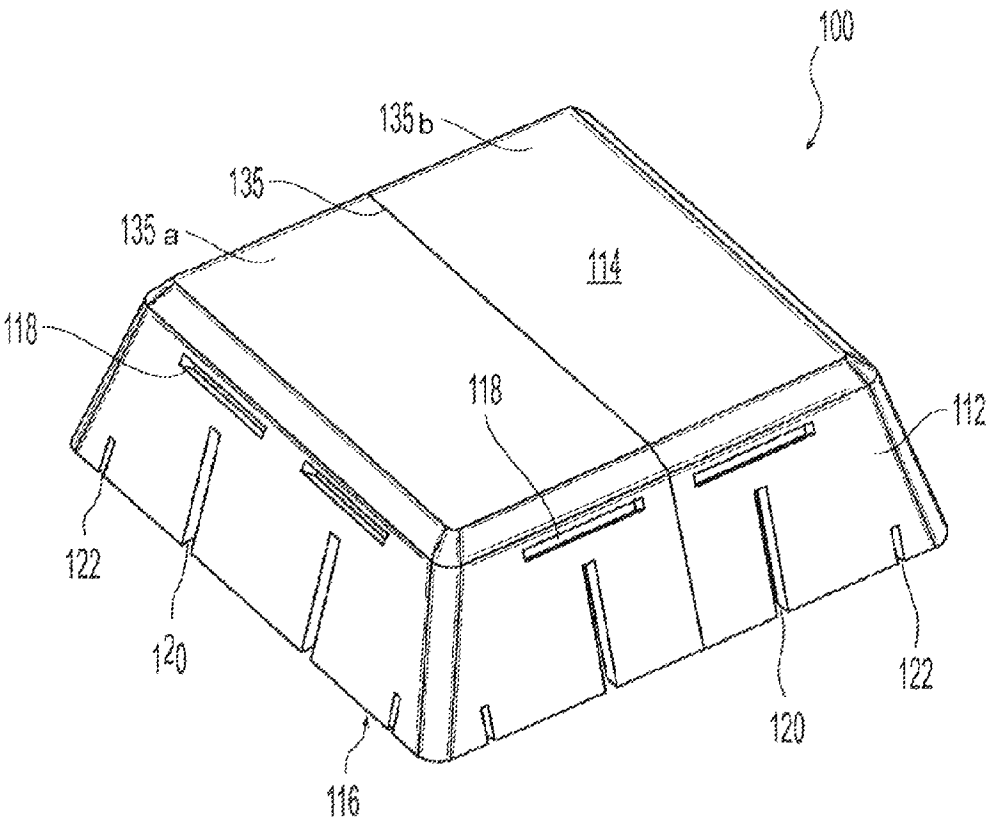
FIG. 2 shows a perspective view of a first embodiment of an acoustic housing according to the present invention.
Figure 3:
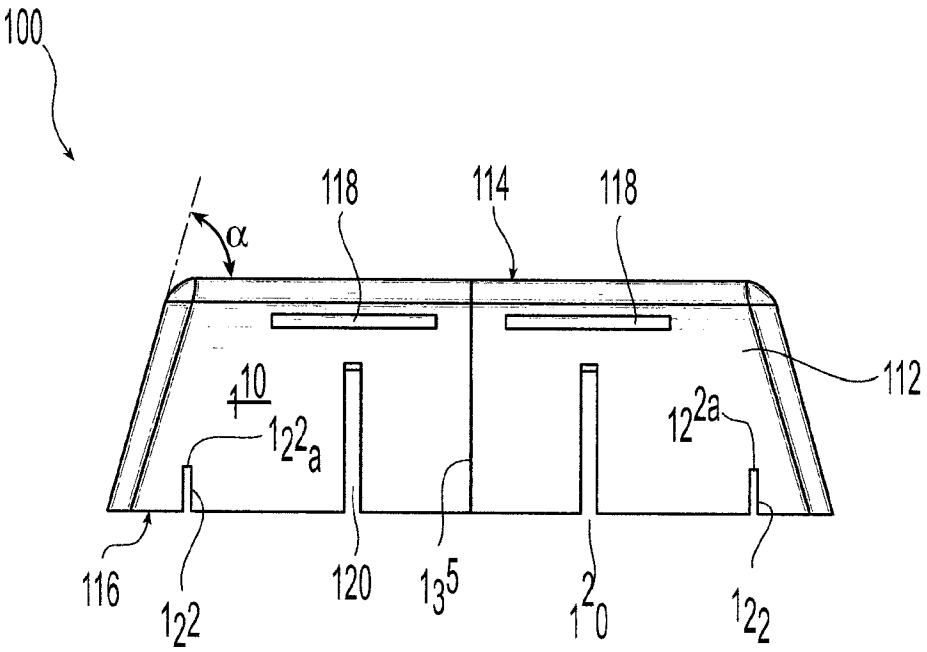
FIG. 3 shows a side view of the embodiment of the acoustic housing of FIG. 2.
Figure 4:
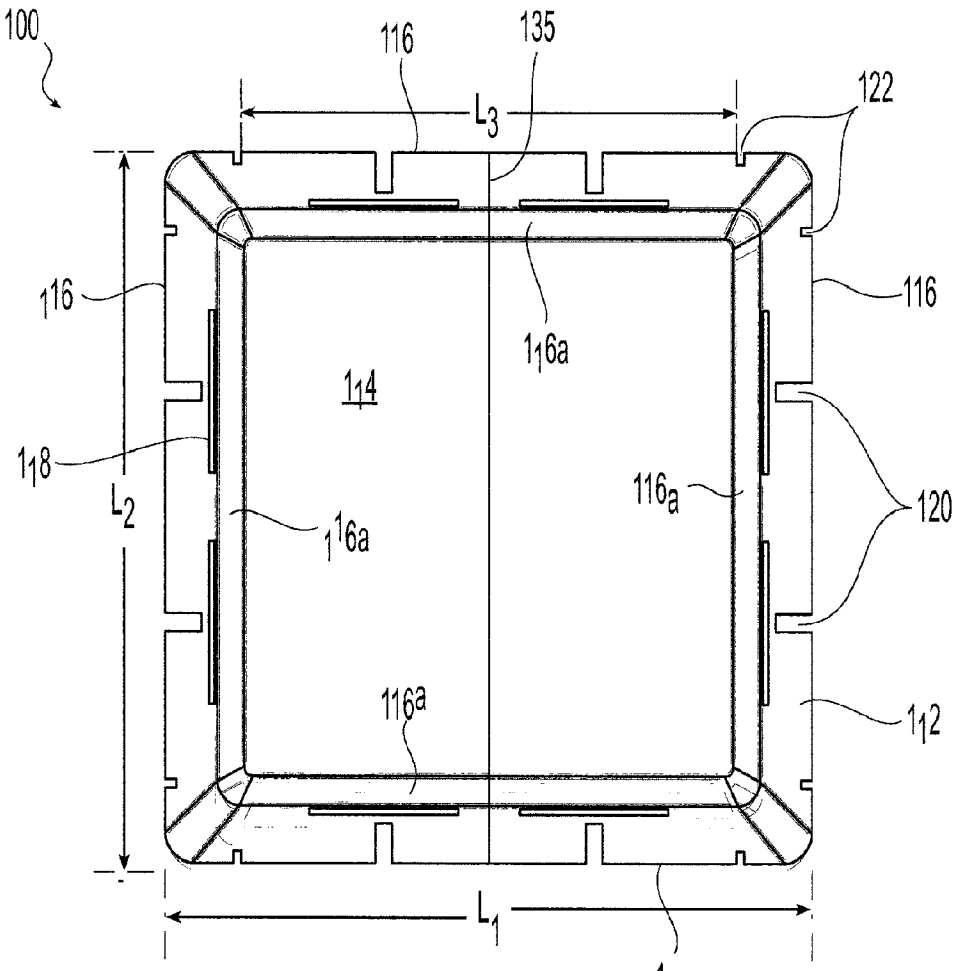
FIG. 4 shows a top view of the embodiment of the acoustic housing of FIG. 2.

Turning to FIGS. 2-4, an uninstalled acoustic hood or housing 100 according to one exemplary embodiment of the present invention is shown. Acoustic housing 100 includes a plurality of sides 112 disposed transverse to a top outside connecting surface 114 and top inside connecting surface 114*a*. Sides 112 define a partially enclosed space. Each side 112 of acoustic housing 100 includes a lower edge 116, with edges 116 together forming a perimeter defining an opening that can be provided in generally the same shape and slightly larger than an underlying light fixture 16 to be acoustically shielded. In this way, sound waves traveling upward through the underlying light fixture 16 enter the partially enclosed space defined by acoustic housing 100. Thus, it should be understood that the portion of the light fixture 16 that is "hidden" above a suspended ceiling may he acoustically shielded by disposing a housing 100 around the fixture. In some embodiments, edges of and intersections between sides 112 and surfaces 114, 114*a* may be beveled, rounded or blunted. In the exemplary embodiment of FIGS. 2-4, housing 100 preferably does not contact underlying light fixture 16. In preferred exemplary embodiments. sides 112 may be disposed with respect to top surface 114 at an angle $\alpha$ between about 65° and about 80°, and more preferably at an angle $\alpha$ between about 70° and about 75°. In one preferred exemplary embodiment, sides 112 may be disposed with respect to top surface 114 at an angle $\alpha$ of about 73°.

In a preferred exemplary embodiment of acoustic housing 100, the perimeter formed by lower edges 116 is generally square and each lower edge 116 has a length $L_1$ or $L_2$ of about 31 inches. Also, upper edge regions 116*a* each may have a length $L_3$ of about 24 inches. In an alternate embodiment, the perimeter formed by lower edges 116 for example may be rectangular such that $L_1$ and $L_2$ are different from one another.

As shown in FIG. 3, at least one side 112 of acoustic housing 100 may be provided with at least one slot or opening. In a preferred exemplary embodiment, a pair of vent slots 118 provide ventilation and cooling to the space defined between an underlying light fixture 16, top surface 114 and sides 112 of housing 100. Vent slots 118 preferably may be oriented parallel to top surface 114. In the exemplary embodiment, vent slots 118 are rectangular and may have dimensions of about 0.5 inches by about 7 inches. However, it should be apparent that vent slots 118 may be provided in any shape, number, size or position effective to ventilate and cool the space between the underlying light fixture 16, top surface 114 and sides 112. As shown in FIG. 4, vent slots 118 may be disposed in a plurality of sides 112.

In addition, utility slots 120 provide a passage for utilities in and out of the space between the underlying light fixture 16, top surface 114 and sides 112, such as an electric conduit to the underlying light fixture 16. As shown in FIGS. 2-4, each side 112 may include multiple utility slots 120 which may be oriented perpendicular to top surface 114 and may extend from edge 116. The exemplary utility slots depicted in FIG. 2 are rectangular and may have dimensions of about 0.75 inches by about 6 inches. It should be apparent that utility slots 120 can be provided in any shape, number, size or position effective to provide utility access to the space between the underlying light fixture 16, top surface 114 and sides 112. As shown in FIG. 4, utility slots 120 may he disposed in a plurality of sides 112.

Positioning slots 122 also are provided to allow acoustic housing 100 to be positioned in relation to an underlying grid formed from inverted T-shaped frame members, as will be discussed below. As shown in FIGS. 2-4, each side 112 may include multiple positioning slots 122 that may be disposed in a plane perpendicular to top surface 114 and preferably extend from edge 116. The exemplary positioning slots 122 depicted in FIG. 2 are rectangular and may have dimensions of about 0.38 inches by about 1.63 inches. It should be apparent that positioning slots 122 may be provided in any shape, number, size or position effective to position acoustic housing 100 in relation to an underlying grid formed from inverted T-shaped frame members. As shown in FIG. 4, positioning slots 122 may be disposed in a plurality of sides 112. Positioning slots optionally may be used so that a portion of T-shaped frame members is received therein.

A variety of slots or openings may be provided instead of, or in addition to those described above, such as circular holes or a field of spaced perforations throughout the housing.

In a preferred exemplary embodiment, acoustic housing 100 may he formed from layered and molded pliant fiberglass with a thickness between about 0.5 inch and about 1.5 inches, preferably between about 0.8 inch and about 1.3 inches, and more preferably about 1 inch. Acoustic housing 100 can be formed by positioning a plurality of layers of "light density" fiberglass in a mold formed to the desired shape. The fiberglass layers then may be successively compressed in the mold at a temperature, for example, of about 400.degree. F., to form acoustic housing 100. After molding, acoustic housing 100 is formed from molded pliant fiberglass having a density of between about 4 lbs. per cubic foot and about 10 lbs. per cubic foot. In some embodiments, acoustic housing 100 preferably has a minimum density of about 6 lbs. per cubic foot. Additional components such as a binder may be included with the fiberglass during the molding process as necessary to form acoustic housing 100 having desired rigid characteristics of portions 135*a*, 135*b*. Acoustic housing 100 alternatively may be formed from other sound absorbing materials such as polyester or another polymer.

Figure 4B:
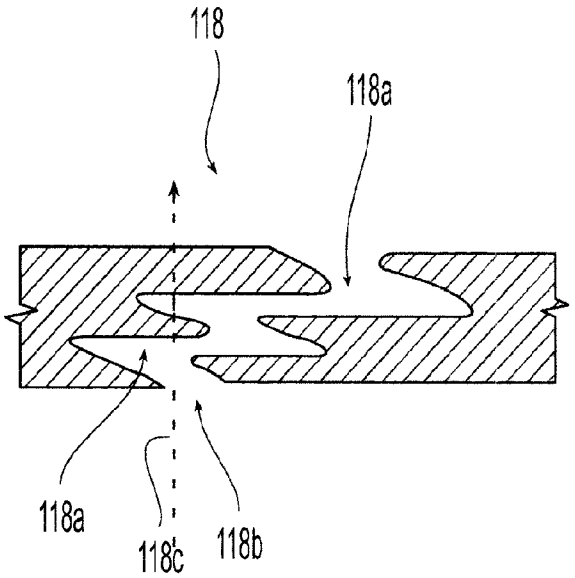
FIG. 4B shows a cross-section through a ventilation opening of the embodiment of the acoustic housing of FIG. 2.
Figure 4A:
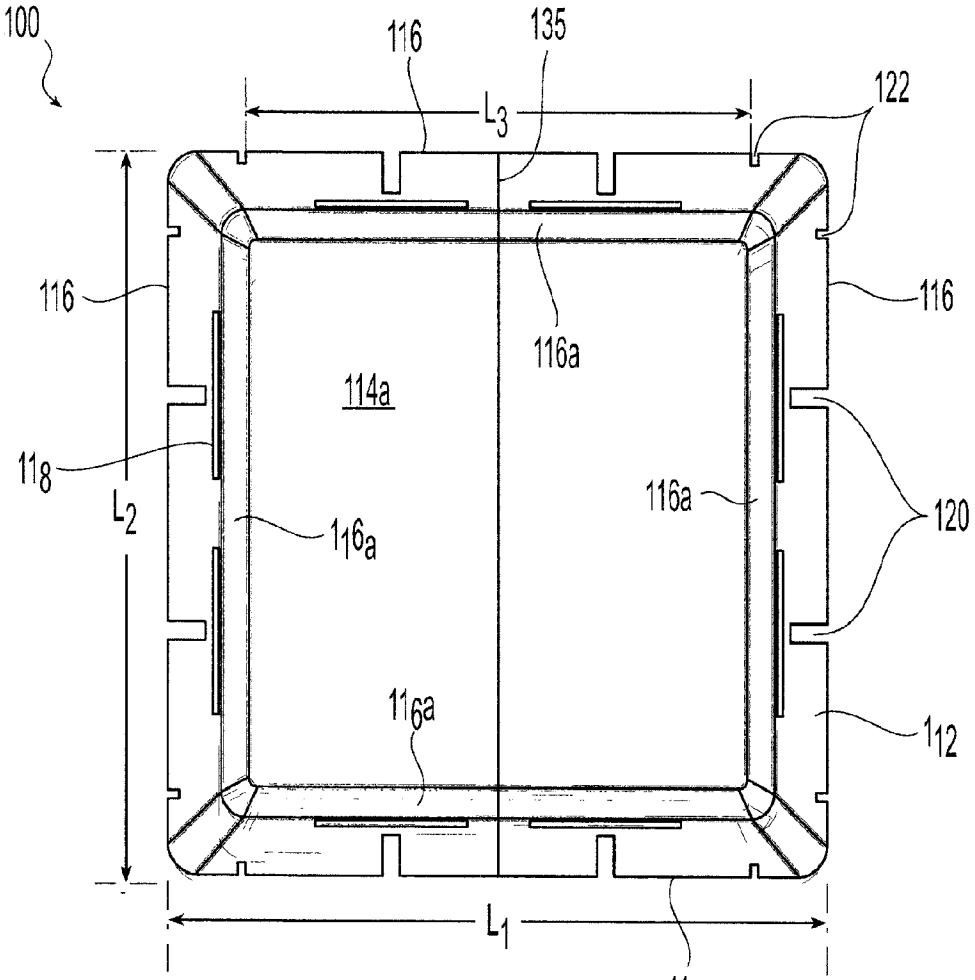
FIG. 4A shows a bottom view of the embodiment of the acoustic housing of FIG. 2.

Alternatively, or in addition, acoustic housing 100 may be formed from a sound reflecting material such as molded polyvinyl chloride (PVC). An acoustic housing 100 formed from a sound reflecting material such as PVC may be more rigid and/or of narrower cross-section than molded pliant fiberglass. Acoustic housing 100 may be formed from any suitable sound reflecting material, such as any suitable plastic or other polymeric material. Acoustic housing 100 formed from a sound reflecting material having a narrow cross section may include openings such as vent slots 118, utility slots 120 and positioning slots 122, as shown in FIGS. 2-4. These openings optionally may provide indirect paths for sound so as to reduce sound transmission proximate the openings. For example, as shown in FIG. 4B, an opening such as vent slot 118 may include a baffling 118*a*, so that sound traveling through area 118*b* along direction 118*c*, for example, is interrupted. A variety of openings may be provided in acoustic housing 100 such as air flow tunnels that have echelle grating type interior surfaces with steep slopes.

In some embodiments, acoustic housing 100 may include layers of both sound absorbing material and sound reflecting material. For example, acoustic housing 100 may include an a first layer of sound absorbing molded pliant fiberglass as well as a second layer of sound reflecting PVC. Preferably, the first layer has a cross-sectional thickness greater than the second layer. The sound reflecting PVC, for example, may have a cross-sectional thickness between about one-quarter inch and about three-eighth inch.

In some embodiments, acoustic housing 100 may include a first layer effective in absorbing sounds such as the human speech frequency range above 125 Hz, and a second layer effective in reflecting sounds such as lower frequency airborne noise originating, for example, from HVAC or other mechanical components located above a suspended ceiling system.

Also in a preferred exemplary embodiment, acoustic housing 100 may be formed from multiple portions. For example, as shown in FIGS. 2-4, interface 135 indicates that acoustic housing 100 is formed from two halves 135*a*, 135*b*. Such a multi-piece construction facilitates installation because the multiple portions are easier for an installer to lift and position with respect to a light fixture 16 due to their individual weight and dimensions as compared to a one-piece acoustic housing, and because the multiple smaller portions are easier to fit through the openings defined by the main beams and cross tees. The multipiece construction of acoustic housing 100 may be created. for example, from a molded housing that is cut into two pieces after molding, such as by water jet cutting. In some multipiece embodiments of acoustic housing 100, the pieces may be coupled together for example using mortise-tenon type, tongue-groove type, or other male-female connections. The individual portions also may be secured together by bonding agents such as glues, or otherwise mechanically fastened to one another to form acoustic housing 100. In an alternate embodiment, however, acoustic housing 100 may be one-piece and of unitary construction.

Figure 5A:
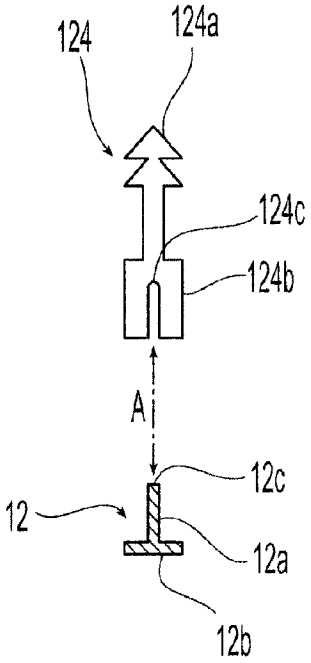
FIG. 5A shows a cross-section of an inverted T-shaped frame member for interfacing with a clip for positioning and securing the acoustic housing of the present invention.
Figure 5:
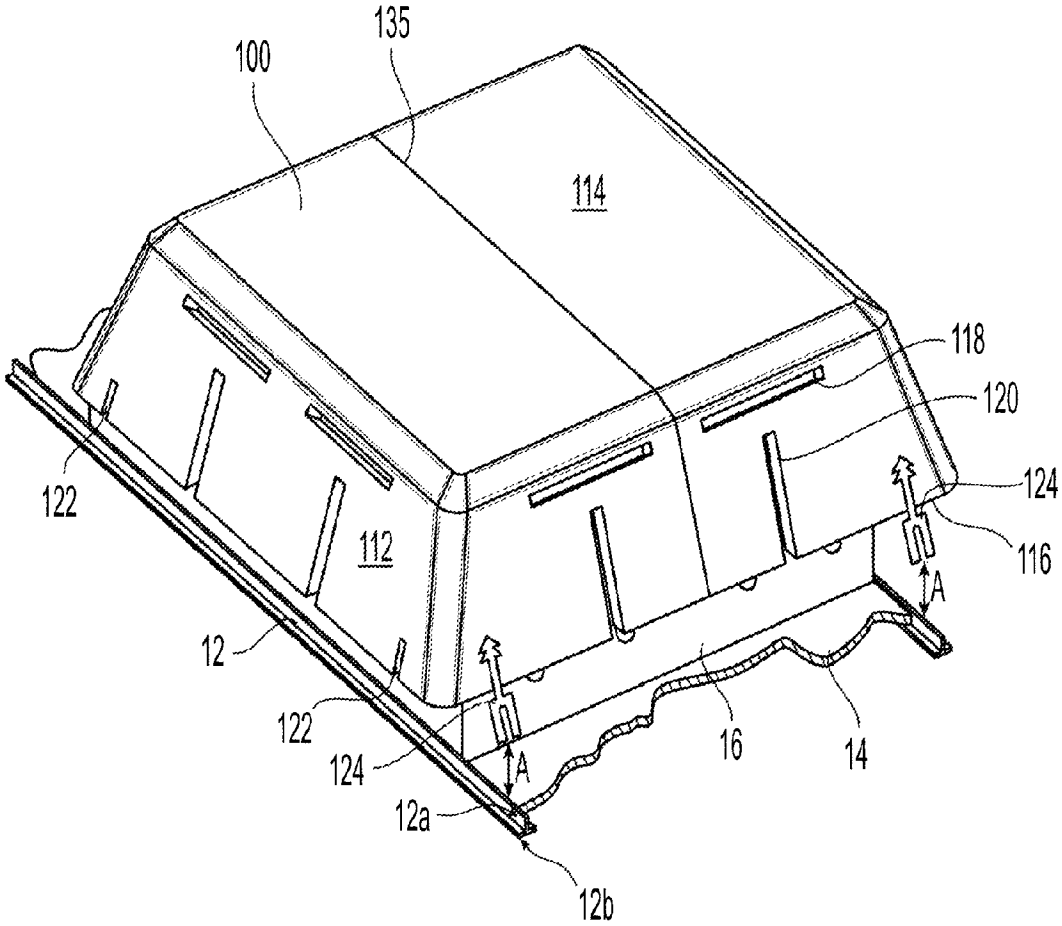
FIG. 5 shows a perspective view of the acoustic housing of FIG. 2 with an embodiment of clips for attaching the housing to frame members of the grid according to the present invention.

Referring now to FIGS. 5-8, a variety of systems may be used to secure an acoustic housing 100 with respect to a light fixture 16. As shown in FIG. 5, a light fixture 16 installed in a suspended ceiling grid formed by inverted T-shaped frame members 12 may be shielded by an acoustic housing 100 supported by the frame members 12. In particular, as shown in FIG. 5A, the inverted T-shaped frame members 12 have a cross-section that defines a stem portion 12*a* and a crossbar portion 12*b*. Ceiling tile 14 for example adjacent to lighting fixture 16 may be positioned on frame members 12 such that the edge portions of a face of ceiling tile 14 are supported by crossbar portions 12*b*. In addition, acoustic housing 100 may be positioned over a lighting fixture 16 and releasably secured in place as now will be described. A pair of positioning slots 122 on a side 112 of acoustic housing 100 are provided such that the spacing between the pair of positioning slots 122 is about the same as the spacing between a pair of stem portions 12*a* of two parallel frame members 12. During installation, the acoustic housing 100 is positioned such that the pair of positioning slots 122 are aligned with a pair of stem portions 12*a*, and then acoustic housing 100 may be positioned such that each of the two positioning slots 122 registers with a stem portion 12*a* so that a stem portion 12*a* is disposed within each slot 122. Positioning slot 122 and stem portion 12*a* may be configured and dimensioned such that an end portion 122*a* of positioning slot 122 (as shown for example in FIG. 5) rests on an edge 12*c* of stem portion 12*a* when acoustic housing 100 is positioned, thereby preventing edges 116 from resting on ceiling tile 14.

Alternatively, as shown in FIGS. 5 and 5A, clips 124 may be used to mechanically couple housing 100 to frame members 12. In particular, each clip 124 may include a head portion 124*a* and a slotted portion 124*b*. A pair of clips 124 for example may be secured to each of two opposing sides of acoustic housing 100 proximate positioning slots 122. Head portions 124 may be formed of double arrow or fishhook configuration and preferably are configured and dimensioned to be mechanically coupled to housing 100 such as by being depressed and embedded into the material forming housing 100. In addition, head portions may be secured or further secured to housing 100 using a glue or other securing and hardening agent. A pair of clips 124 with slotted portions 124*b* thus may be provided such that the spacing between the pair of slotted portions 124*b* is about the same as the spacing between a pair of stem portions 12*a* of two generally parallel frame members 12. During installation, the acoustic housing 100 is positioned such that each pair of slotted portions 124*b* is aligned with a pair of stem portions 12*a*, and then acoustic housing 100 may be positioned such that each of the slotted portions 124*b* registers with a stem portion 12*a*, for example in the direction of arrow A, so that a stem portion 12*a* is disposed within each slotted portion 124*b*. Each slotted portion 124*b* and stem portion 12*a* may be configured and dimensioned such that an end portion 124*c* of slotted portion 124*b* rests on an edge 12*c* of stem portion 12*a* when acoustic housing 100 is positioned, thereby preventing edges 116 from resting on ceiling tile 14. Thus, multiple clips 124 may be installed such that acoustic housing 100 is supported over underlying light fixture 16 exclusively by clips 124 resting on stem portions 12*a* of frame members 12.

Figure 6:
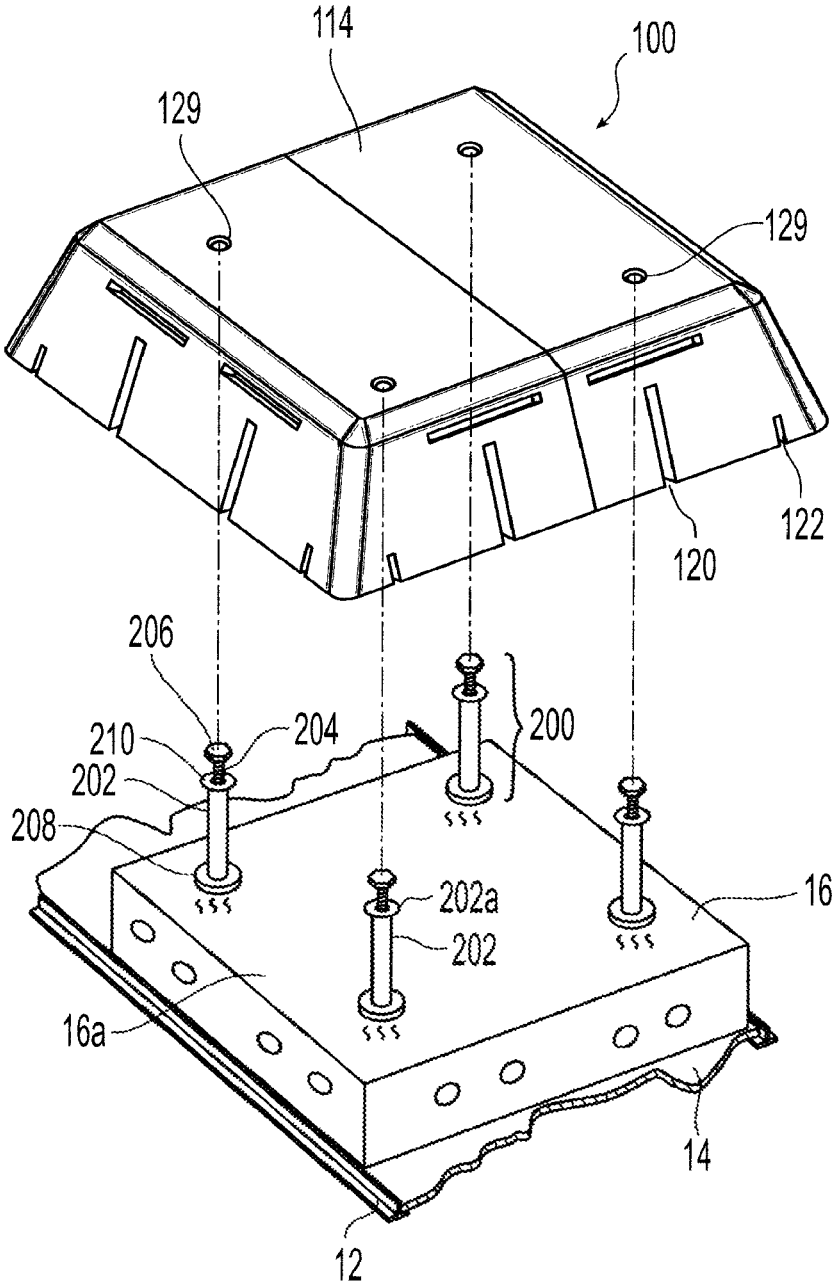
FIG. 6 shows a perspective view of an acoustic housing suspended using a conduit assembly according to the present invention.

Referring now to FIG. 6 another manner of supporting acoustic housing 100 is shown whereby acoustic housing 100 is supported above underlying light fixture 16 by conduit assemblies 200. Each conduit assembly 200 includes a conduit or tubular member 202 which acts as a spacer between lighting fixture 16 and acoustic housing 100 and through which a threaded bolt 204 may extend. Preferably, bolt 204 is longer than tubular member 202 and a threaded end portion protrudes from an end 202*a* of member 202. A washer 210 may rest on end 202*a*. In addition, a magnet 208 is provided with a central hole therein that receives conduit 202 and is disposed proximate an end thereof.

During installation, a head of bolt 204 (not shown) is disposed on the inside surface of light fixture 16 while magnet 208 is disposed on the outside surface 16*b* as shown in FIG. 6. In this orientation, the shaft of bolt 204 extends through a hole in light fixture 16 with tubular member 202 being received on the shaft of bolt 204. Washer 210 rests on end 202*a* of tubular member 202. Acoustic housing 100 next is positioned so that holes 129 in top surface 114 are aligned with threaded end portions of each bolt 204 extending therethrough. Finally, acoustic housing 100 is secured in place by threadably associating a nut with the threaded end portion of the shaft of bolt 204 extending above top surface 114. Magnet 208 placed against lighting fixture 16 secures conduit assembly 200 to lighting fixture 16 by magnetic force.

Figure 7:
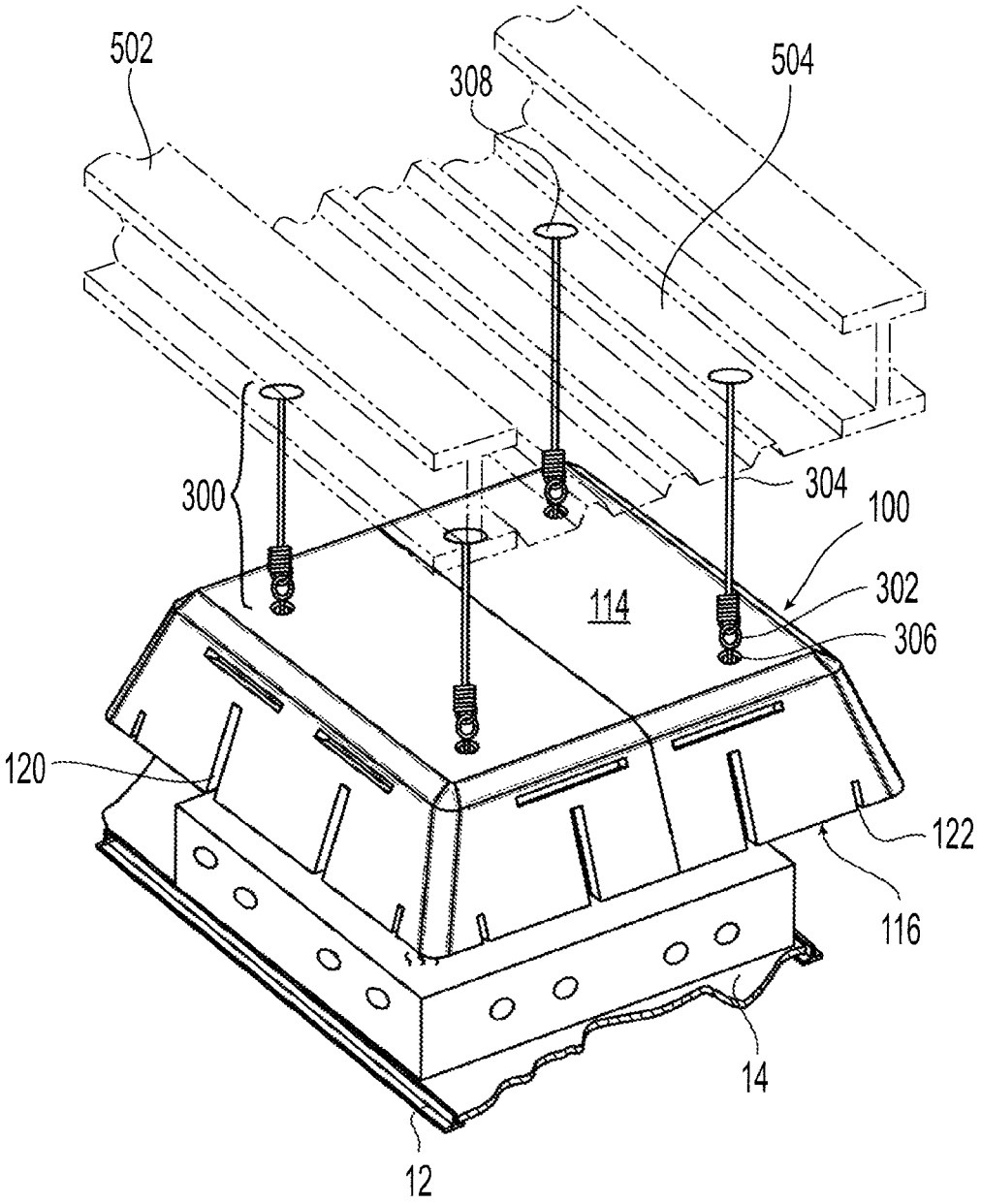
FIG. 7 shows a perspective view of an acoustic housing suspended using a hanger assembly according to the present invention.

In another securing system, shown in FIG. 7, an acoustic housing 100 is supported above underlying light fixture 16 by hanger assemblies 300. Each hanger assembly 300 includes an eye bolt 302 secured to acoustic housing 100 at a predetermined position such that the "eye" portion of the eye bolt 302 extends above top surface 114 of acoustic housing 100. Hanger wire 304 is then secured to eye bolt 302 at one end and extended toward a surface above acoustic housing 100. The end of hanger wire 304 not secured to eye bolt 302 is coupled to a magnet 308 which may be magnetically coupled to an overlying surface. Examples of overlying surfaces to which magnets 308 may be secured include an I-beam 502 or a ribbed steel pan 504.

Figure 8:
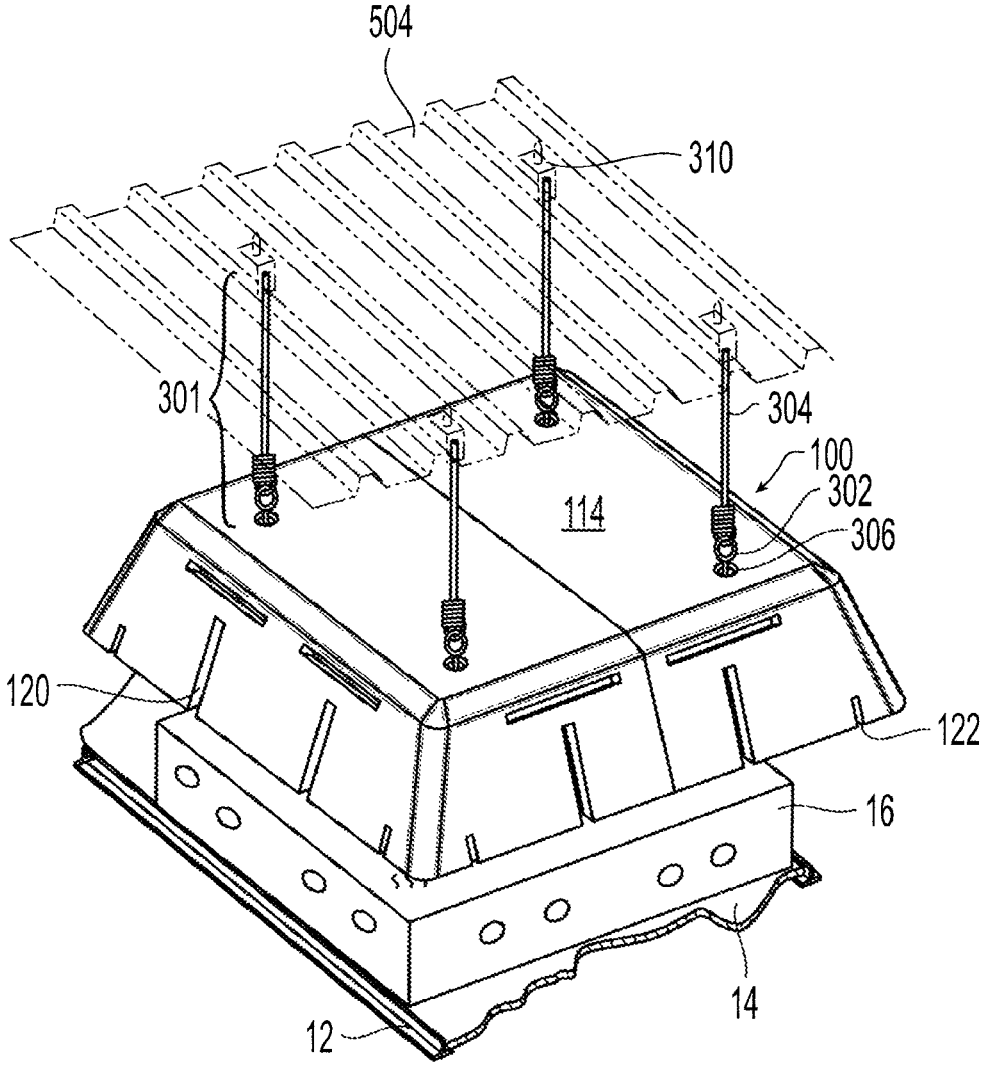
FIG. 8 shows a perspective view of another acoustic housing suspended using a hanger assembly according to the present invention.

Referring now to FIG. 8, yet another securing system is shown whereby acoustic housing 100 is supported above underlying light fixture 16 by a second type of hanger assembly 301. Hanger assembly 301 resembles hanger assembly 300, except instead of magnets, steel brackets 310 are used to secure an end of hanger wire 304 to an overlying surface. According to this installation embodiment, the overlying surface need not be magnetic; therefore acoustic housing 100 can be suspended from a nonmagnetic surface, such as a concrete surface.

Thus, advantageously, although ceiling tiles often must be removed or displaced from their location in the ceiling grid to permit maintenance of pipes, electrical equipment, air handling equipment, or other matters to be performed above the suspended ceiling, an acoustic housing 100 supported by the frame members 12 need not be moved. Because of the size and weight of acoustic housing 100, it is preferable that housing 100 be left in place once installed. In addition, advantageously the alignment of acoustic housing 100 supported by the frame members 12 may be maintained during such maintenance operations, so that it is unnecessary to adjust and realign housing 100 to provide the desired acoustic shielding each time maintenance may be performed.

Figure 9A:
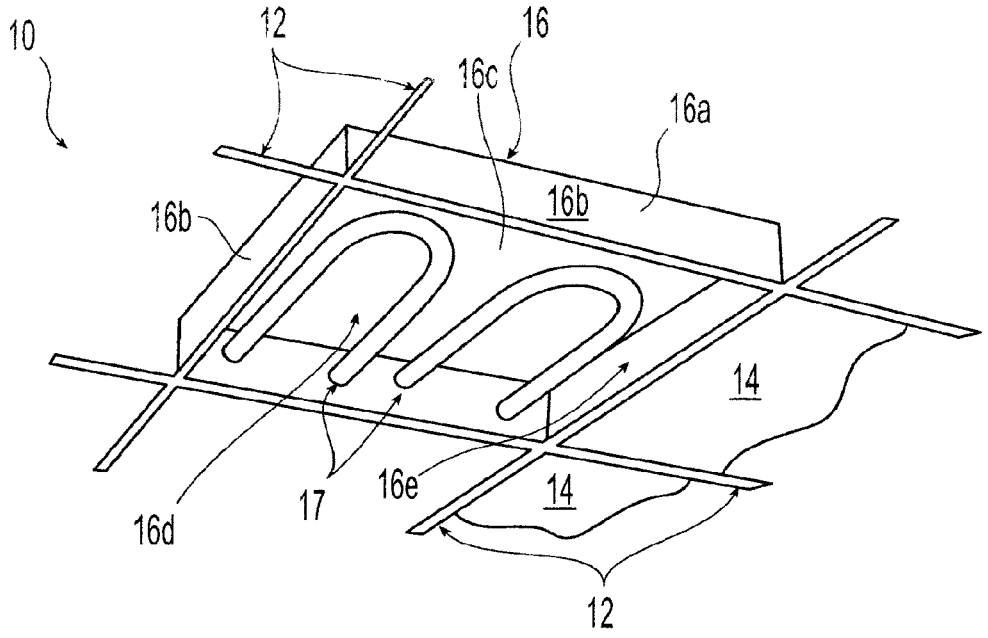
FIG. 9A (Prior Art)
FIG. 9A shows a bottom perspective view of a known ceiling system with a recessed light fixture.
Figure 9B:
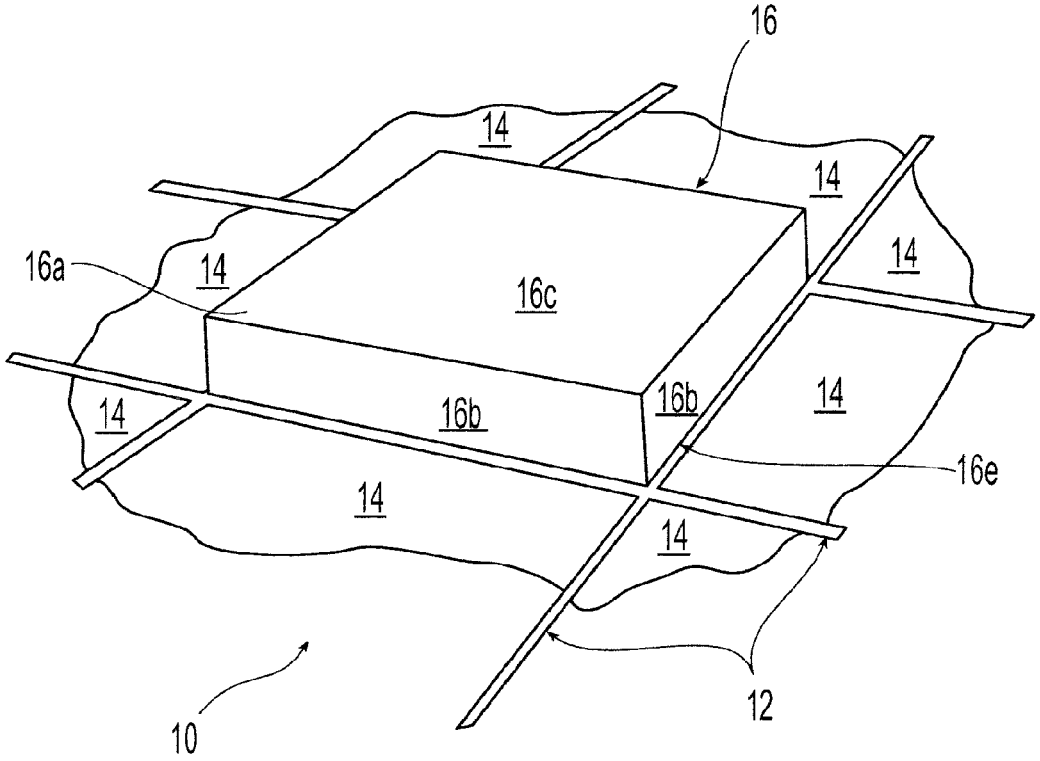
FIG. 9B (Prior Art)
FIG. 9B shows a top perspective view of the known ceiling system with a recessed light fixture of FIG. 9A.

Referring next to FIGS. 9A-9B, a recessed light fixture installed in a suspended ceiling system is shown installed as a component of a suspended ceiling system 10, similar to FIG. 1. The recessed light fixture 16 of FIGS. 9A-9B includes a housing 16*a* having a plurality of sides 16*b* and a connecting surface 16*c* which in some embodiments may be at least partially reflective (e.g., having a white matte finish or a silver finish) on the side facing lighting elements 17 such as fluorescent lamps. Fixture 16 also includes a main opening 16*d* defined by sides 16*b* and connecting surface 16*c* in which lighting elements 17 are installed and through which light may be transmitted to illuminate regions thereunder. Housing 16*a* is configured and dimensioned so that recessed light fixture 16 can be installed as a component in a suspended ceiling system 10, for example, with an edge 16*e* of each side 16*b* being supported by a frame member 12. Although not specifically shown, the light distribution from the luminaires may be controlled by a diffuser such as a louver diffuser, prismatic diffuser, opal diffuser, eggcrate diffuser, or metallized plastic grid diffuser as known in the art.

As shown in FIG. 9A-9B, when recessed light fixture 16 is installed as a component of suspended ceiling system 10 including ceiling tiles 14, the upper surface 16*c* and sides 16*b* are positioned and supported on one side of the plane formed by frame members 12 such that sides 16*b* are not visible when ceiling tiles 14 are installed around recessed light fixture 16.

Figure 10A:
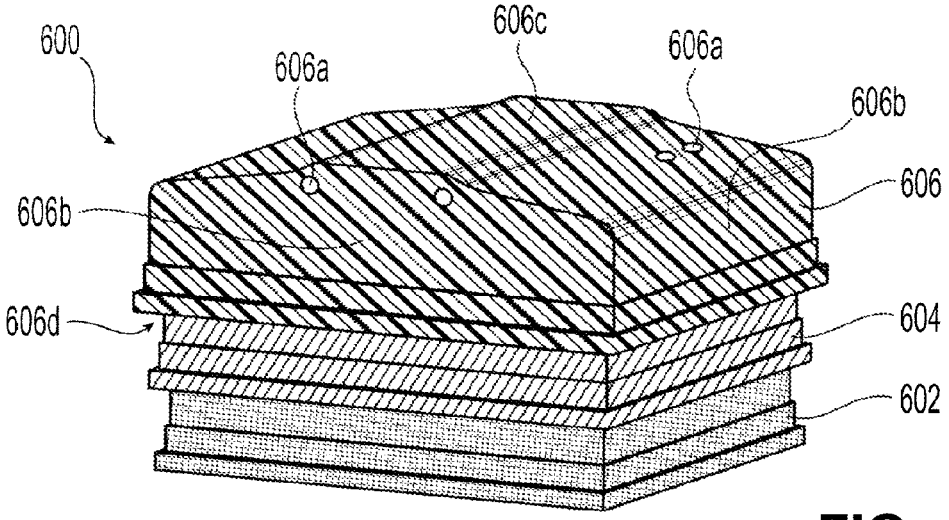
FIG. 10A shows a partially exploded perspective view of an embodiment of an acoustically shielded recessed light fixture for use in the ceiling system of FIGS. 9A-9B according to the present invention.

Although the aforementioned embodiments of the present invention involve acoustic housings that may be at least partially spaced from separate fixtures 16, other exemplary embodiments of the present invention involve an acoustic housing that is configured and dimensioned to form part of a fixture 16. In particular, referring now to FIGS. 10A-10B, an acoustic recessed light fixture 600 according to one exemplary embodiment of the present invention includes a inner layer 602, middle layer 604, and outer layer 606. In alternate embodiments, only one or two such layers or more than three layers may be provided. In one exemplary preferred embodiment, fixture 600 includes a steel mesh inner layer 602, a one inch rated glass inner core 604 (a fiberglass composite that is fire-rated for safety due to electrical components and heat), and a steel outer layer 606. Steel mesh inner layer 602 is perforated thereby permitting sound to travel therethrough and be damped by glass inner core 604. Steel outer layer 606 is provided so that conduit or electrical fittings may be supplied to underlying light fixture 16. Acoustic housing 600 is adapted to be coupled directly to a light fixture 16, and in particular may be custom molded to the outside of all brands of fluorescent lighting.

As shown, middle acoustic housing 604 may be positioned within outer housing 606 which both also may include a plurality of holes 604*a*, 606*a*, respectively, to provide ventilation for acoustic recessed light fixture 600 as well as a passageway for physical connections such as electrical connections to lighting elements 17. Outer housing 606 also includes sides 606*b*, an upper surface 606*c* and an opening 606*d* defined by sides 606*b* and upper surface 606*c*. Outer housing 606 may be formed from metal such as steel and may be constructed, for example, by stamping a rolled steel sheet into a predetermined shape having desired dimensions, or alternatively housing 606 may be formed of any other suitable material such as polymeric material.

Similar to outer housing 606, middle acoustic housing 604 may include a plurality of sides 604*b*, an upper surface 604*c*, and an opening 604*d* defined by sides 604*b* and upper surface 604*c*. The shape and dimensions of housings 604, 606 preferably are selected to permit middle acoustic housing 604 and outer housing 606 to closely mate when housing 604 is positioned in opening 606*d* to form a nested configuration. Preferably, stepped regions or flanges 604*e*, 606*e* mate. In some embodiments, middle acoustic housing 604 may be formed from layered and molded pliant fiberglass with a thickness of approximately 1 inch. Middle housing 604 for example may have a thickness between about 0.3 inch and 1.5 inch, between about 0.5 inch and 1.3 inches, or between 0.8 inch and 1.3 inches. Acoustic housing 604 alternatively may be formed from other sound absorbing materials such as polyester.

An inner layer 602 optionally may be included and may be formed from any suitable acoustically transparent material such as steel wire mesh or alternatively another material such as a polymeric material. Inner layer 602 may have a plurality of sides 602*b*, an upper surface 602*c*, and an opening 602*d* defined by sides 602*b* and upper surface 602*c*. Inner layer 602 may be configured and dimensioned in a manner that facilitates nesting of inner layer 602 within opening 604*d* of acoustic housing 604, similar to the nesting previously described for components 604, 606. Inner layer 602 may additionally include a flange 602*e* that can be secured to flange 604*e* during nesting.

In some exemplary embodiments, an acoustic housing 604 is custom molded and secured to outer layer 606; in other exemplary embodiments, a suitably configured and dimensioned layer 606 instead may be nested within an acoustic housing 604 so that housing 604 instead surrounds a preferably metal layer 606.

In some embodiments, as described above with reference to acoustic housing 100, acoustical light fixture 600 may include a layer 602, 604, 606 formed of a sound absorbing material such as fiberglass, and another layer 602, 604, 606 formed of a sound reflecting material such as PVC. As shown in FIG. 4B with respect to openings in acoustic housing 100, at least one ventilation opening 606*a* may be provided in one or more of layers 602, 604, 606 which optionally may provide indirect paths for sound so as to reduce sound transmission proximate the openings. Thus, the previous description of baffle portion 118*a* and air flow tunnels with echelle grating type interior surfaces also applies to light fixture 600.

In some embodiments, light fixture 600 may include a first layer effective in absorbing sounds such as the human speech frequency range above 125 Hz, and a second layer effective in reflecting sounds such as lower frequency airborne noise originating, for example, from HVAC or other mechanical components located above a suspended ceiling system.

Figure 10B:
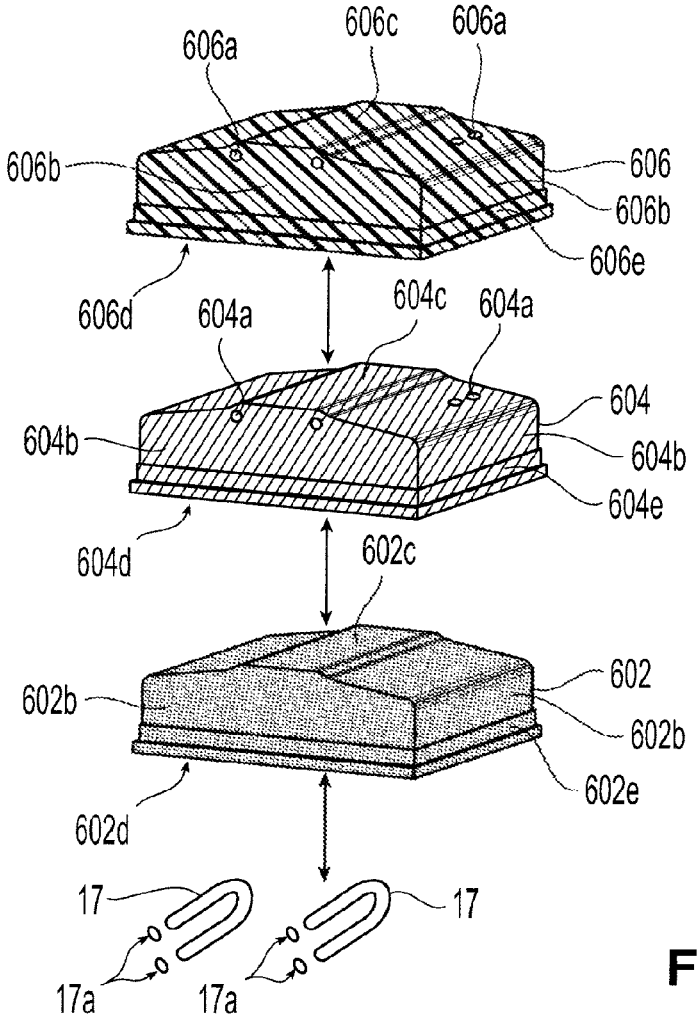
FIG. 10B shows an exploded perspective view of the acoustically shielded recessed light fixture of FIG. 10A with lighting elements and sockets shown schematically.

Acoustic recessed light fixture 600 additionally includes lighting elements 17 as shown schematically in FIG. 10B. The light elements 17 for example may be disposed in one of the following manners. In one embodiment of fixture 600, layer 602 is not included and lighting elements 17 are secured within layer 604. In another embodiment, layers 602, 604 are included and lighting elements 17 are secured within layer 602. In particular, the bulb sockets 17*a*, shown schematically in FIG. 10B, may be mounted in or to layers 602 or 604 with associated electrical connections extending therethrough, and the ballast and starter switch may be secured to the layers forming fixture 600. Thus, a light fixture may include an integrally incorporated layer for soundproofing.

As with previously described acoustic housing 100, the light fixture 600 also may include features such as utility slots, positioning slots, and ventilation openings. In addition, layers 602, 604, 606 optionally may be supplied in a prefabricated, assembled condition in which the layers are already coupled together, or alternatively layers 602, 604, 606 optionally may be supplied separately for possible assembly "on-site." Also, in order to provide a variety of options for materials, fixture weight, noise reduction coefficient (as will be described shortly), and other properties in order to meet a desired end use, the materials and dimensions of layers 602, 604, 606 may be selectable from a set of standardized or custom options. Thus, the components may be individually available for custom fabrication for a buyer, or otherwise individually available for on-site assembly. Moreover, although in one embodiment of fixture 600, two or more of layers 602, 604, 606 are coupled together to form an integral unit, in another embodiment of fixture 600 multiple layers may form a fixture 600 which has several sections that fit together to form the light fixture housing. For example, the light fixture housing formed by layers 602, 604, 606 may be supplied in multipiece construction such as two substantially symmetrical portions that together form the housing as previously described with respect to acoustic housing 100 with interface 135. Each of the optional methods previously described for acoustic housing 100 for coupling the pieces together in such a multipiece construction apply equally to a multipiece housing formed of layers 602, 604, 606.

Although described and shown with reference to a substantially rectangular recessed light fixture, it should be noted that the present invention is applicable to other forms of recessed lights, including without limitation cylindrical can light installations and fluorescent troffer light systems.

In one preferred exemplary embodiment of the present invention, the suspended ceiling and components meet ASTM Standard C635-04 entitled "Standard Specification for the Manufacture, Performance, and Testing of Metal Suspension Systems for Acoustical Tile and Lay-in Panel Ceilings" and ASTM Standard C636-04 entitled "Standard Practice for Installation of Metal Ceiling Suspension Systems for Acoustical Tile and Lay-In Panels," and these standards are incorporated herein by reference thereto.

In addition, acoustic housings and light fixtures 100, 600, respectively, preferably have a Class A fire rating. Also, acoustic housings and light fixtures 100, 600, respectively, preferably may have a noise reduction coefficient (NRC) of between about 0.05 and about 1.0, and more preferably have an NRC of at least 0.7, at least 0.8, or at least 0.9. In one exemplary preferred embodiment, acoustic housings and light fixtures 100, 600, respectively, have an NRC of between about 0.8 and about 0.9.

For the purposes of the present invention, the NRC is calculated according to ASTM Standard C423-02a entitled "Standard Test Method for Sound Absorption and Sound Absorption Coefficients by the Reverberation Room Method," which is incorporated herein by reference thereto.

While the NRC generally is a measure of the effectiveness of absorbing sound waves, the sound transmission class (STC) generally is a measure of the effectiveness of blocking sound waves.

For acoustic housings and light fixtures 100, 600 that are formed from a sound reflecting material, such as PVC, in accordance with the present invention, in some embodiments they have an STC of at least about 15, at least about 20, at least about 25, or at least about 30. As the STC increases, sources of speech-related noise are blocked to a greater degree. Thus, in order to block undesired speech transmission, for example, in one exemplary embodiment an STC of at least about 20 is desirable.

The STC is determined, particularly for air-borne sound at speech frequencies, according to ASTM Standard E90-04 entitled "Standard Test Method for Laboratory Measurement of Airborne Sound Transmission Loss of Building Partitions and Elements" and ASTM Standard E413-04 entitled "Classification for Rating Sound Insulation," which are incorporated herein by reference thereto. It is known that the STC's of laboratory samples of acoustic housings or light fixtures 100, 600 may not be the same as STC's measured in field tests in installations in actual building settings, and thus a different ASTM standard covers a method for measurement of airborne sound insulation in buildings. For the purposes of the present invention, STC's described herein are to be determined according to the aforementioned ASTM Standards E90-04 and E413-04.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. For example, hanger assemblies 300, 301 can employ any suitable means for attaching an end of hanger wire 304 to an overlying surface. Additionally, any known method may be used to secure acoustic housing 100 to a hanger wire. Regarding spacer 200, any suitable hardware or combination of hardware may be used to provide the desired spacing. Other types of recessed light fixtures for suspended ceilings, such as recessed can lights, also may be acoustically shielded in accordance with the principles of the present invention. In addition, other components of suspended ceilings may he acoustically shielded using housings as disclosed herein, such as HVAC elements. Furthermore, although acoustic housing 100 has been described in an exemplary two-part embodiment with symmetrical halves, other constructions for facilitating installation such as collapsible one-piece embodiments are envisioned to permit positioning through ceiling grids. Moreover, if an air plenum is formed between ceiling tiles 14 and structure of the building, it may be desirable to form housing 100 to be aerodynamic to facilitate air movement. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A method of decreasing sound transfer from a light fixture configured and dimensioned to house a lighting element, the light fixture in a suspended ceiling with a grid system, to a space remote from the light fixture, the method comprising:

disposing an acoustic housing at least partially spaced from the light fixture and at least partially supported by the grid system, the acoustic housing comprising a plurality of rigid portions of sound-absorbing material that together form a partially enclosed space and the rigid portions together form a lower edge defining a perimeter of an opening in the acoustic housing dimensioned to have a shape approximately the same as formed by a perimeter of the light fixture;

coupling at least one spacer to the light fixture;

coupling the acoustic housing to the at least one spacer so that the acoustic housing is supported by the light fixture in a spaced relation thereto.

2. The method of claim 1, further comprising:

supporting at least one edge of the acoustic housing on at least one frame member of the suspended ceiling so that the acoustic housing and the light fixture do not contact one another.

3. The method of claim 1, wherein the acoustic housing comprises at least one positioning slot and the grid system comprises at least one frame member with a protruding portion, the method further comprising:

registering the at least one positioning slot with the protruding portion so that the acoustic housing is supported on the at least one frame member.

4. The method of claim 1, further comprising:

at least partially surrounding the light fixture with the acoustic housing.

5. The method of claim 1, further comprising:

supporting at least one edge of the acoustic housing on at least one frame member of the suspended ceiling.

6. The method of claim 1, further comprising:

coupling at least one spacer to the acoustic housing;

coupling the at least one spacer to at least one frame member of the suspended ceiling.

7. The method of claim 6, wherein the spacer comprises a slot and the at least one frame member comprises an inverted T-shape with a stem portion, the method further comprising disposing the stem portion in the slot.

8. The method of claim 1, wherein the acoustic housing comprises substantially symmetrical halves, the method further comprising:

supporting a first of the halves; and supporting a second of the halves.

9. The method of claim 1, wherein the spacer is a post.

10. The method of claim 1, further comprising:

supporting the acoustic housing from an overlying surface.

11. The method of claim 10, wherein the overlying surface is selected from the group consisting of a concrete structure, an I-beam, and a ribbed steel pan.

12. The method of claim 10, further comprising:

coupling the acoustic housing to a hanger;

coupling the hanger to the overlying surface;

wherein the acoustic housing is supported by the overlying surface in a spaced relation thereto.

13. The method of claim 12, wherein the hanger is a metal cable.

14. The method of claim 1, wherein the acoustic housing provides a noise reduction coefficient of at least 0.7.

15. The method of claim 1, wherein the acoustic housing provides a noise reduction coefficient of at least 0.8.

16. The method of claim 1, wherein the acoustic housing provides a noise reduction coefficient of at least 0.9.

17. The method of claim 1, wherein the acoustic housing provides a sound transmission class of at least about 15.

18. The method of claim 1, wherein the acoustic housing provides a sound transmission class of at least about 20.

19. The method of claim 1, wherein the acoustic housing provides a sound transmission class of at least about 25.

20. The method of claim 1, wherein the acoustic housing provides a sound transmission class of at least about 30.

21. The method of claim 1, wherein the acoustic housing is supported by the suspended ceiling on at least one frame thereof.

22. A method of decreasing sound transfer from a recessed light fixture for a suspended ceiling, the recessed light fixture comprising a light fixture housing configured to at least partially reflect light from a lighting element, to a space remote from the recessed light fixture, the method comprising:

disposing an acoustic housing at least partially spaced from the recessed light fixture, wherein the acoustic housing is not integrally formed with the recessed light fixture, is rigid, has a thickness between about 0.5 inch and about 1.5 inches, comprises sound-absorbing material, and has a lower edge defining a perimeter of an opening in the acoustic housing dimensioned to have a shape approximately the same as formed by a perimeter of the recessed light fixture;

coupling at least one clip to the acoustic housing;

coupling the at least one clip to at least one frame member of the suspended ceiling.

23. The method of claim 22, wherein the light fixture housing comprises a surface that is at least partially reflective on a side thereof facing the lighting element.

24. The method of claim 23, wherein the lighting element is a fluorescent lamp.

25. The method of claim 22, wherein the acoustic housing comprises fiberglass.

26. The method of claim 22, wherein the acoustic housing comprises molded fiberglass having a density of between about 4 lbs. per cubic foot and about 10 lbs. per cubic foot.

27. The method of claim 22, wherein the acoustic housing comprises a first layer of molded fiberglass and a second layer of a different material from the first layer.

28. The method of claim 22, wherein the acoustic housing includes a first layer comprising polyester and a second layer comprising a different material from the first layer.

29. The method of claim 22, further comprising:

supporting the acoustic housing on at least one frame member of the suspended ceiling.

30. The method of claim 29, wherein the acoustic housing comprises at least one positioning slot and the at least one frame member comprises a protruding portion, the method further comprising:

registering the at least one positioning slot with the protruding portion so that the acoustic housing is supported on the at least one frame member.

31. The method of claim 22, further comprising:

supporting at least one edge of the acoustic housing on at least one frame member of the suspended ceiling.

32. The method of claim 22, wherein the acoustic housing comprises substantially symmetrical halves, the method further comprising:

supporting the halves on the suspended ceiling proximate each other to form a partially enclosed space.

33. The method of claim 22, wherein the acoustic housing provides a noise reduction coefficient of at least 0.7.

34. The method of claim 22, wherein the acoustic housing provides a sound transmission class of at least about 15.

35. A method of decreasing sound transfer from a recessed light fixture for a suspended ceiling, the recessed light fixture comprising a light fixture housing configured to at least partially reflect light from a lighting element, to a space remote from the recessed light fixture, the method comprising:

disposing an acoustic housing at least partially spaced from the recessed light fixture, wherein the acoustic housing has a thickness between about 0.5 inch and about 1.5 inches and comprises a plurality of rigid portions formed of sound-absorbing material that together form a partially enclosed space not integrally formed with the recessed light fixture, with the rigid portions together forming a lower edge defining a perimeter of an opening in the acoustic housing dimensioned to have a shape approximately the same as formed by a perimeter of the recessed light fixture;

coupling the plurality of rigid portions together;

at least partially supporting the acoustic housing on at least one frame member of the suspended ceiling;

coupling at least one spacer to the recessed light fixture;

coupling the acoustic housing to the at least one spacer so that the acoustic housing is supported by the recessed light fixture in a spaced relation thereto.

36. The method of claim 35, wherein the acoustic housing comprises molded fiberglass.

37. The method of claim 35, wherein the acoustic housing has a thickness between about 0.8 inch and about 1.3 inches.

* * * * *